US007380354B2

(12) United States Patent
Yamashita et al.

(10) Patent No.: US 7,380,354 B2
(45) Date of Patent: Jun. 3, 2008

(54) SHOE THAT FITS TO A FOOT WITH BELTS

(75) Inventors: Yoshio Yamashita, Kobe (JP); Yasuhiro Morikawa, Kobe (JP); Jhon Lu, Kobe (JP)

(73) Assignee: ASICS Corporation, Kobe (JP)

( * ) Notice: Subject to any disclaimer, the term of this patent is extended or adjusted under 35 U.S.C. 154(b) by 641 days.

(21) Appl. No.: 10/994,573

(22) Filed: Nov. 22, 2004

(65) Prior Publication Data

US 2005/0115111 A1 Jun. 2, 2005

(30) Foreign Application Priority Data

Nov. 28, 2003 (JP) ..... 2003-398497

(51) Int. Cl.
*A43B 7/14* (2006.01)
*A43C 11/00* (2006.01)

(52) U.S. Cl. ..... 36/88; 36/89; 36/50.1

(58) Field of Classification Search ..... 36/88, 36/89, 99, 58.5, 50.1; D2/907, 911; 24/442
See application file for complete search history.

(56) References Cited

U.S. PATENT DOCUMENTS

| | | | | |
|---|---|---|---|---|
| 1,643,108 | A | 9/1927 | Bendelari | |
| 1,805,728 | A | 5/1931 | Sohn | |
| 2,356,490 | A | 8/1944 | Crotty | |
| 2,513,005 | A | 6/1950 | Crawford | |
| 3,327,410 | A * | 6/1967 | Park, Sr. et al. | 36/89 |
| 3,601,909 | A | 8/1971 | Amendola | |
| 3,626,610 | A | 12/1971 | Dassler | |
| 4,080,745 | A | 3/1978 | Torrance | |
| 4,126,951 | A | 11/1978 | Antonious | |
| 4,411,077 | A * | 10/1983 | Slavitt | 36/89 |
| 4,486,965 | A | 12/1984 | Friton | |
| 4,577,419 | A | 3/1986 | Chassaing | |
| 4,677,767 | A | 7/1987 | Darby | |
| 4,845,864 | A | 7/1989 | Corliss | |
| 4,922,630 | A * | 5/1990 | Robinson | 36/89 |

(Continued)

FOREIGN PATENT DOCUMENTS

| | | |
|---|---|---|
| JP | 02-33611 | 3/1990 |
| JP | 08-131201 | 5/1996 |
| JP | 2001-112510 | 4/2001 |

*Primary Examiner*—Jila M. Mohandesi
(74) *Attorney, Agent, or Firm*—Michael E. Zall

(57) ABSTRACT

A shoe with belts according to the present invention comprising an upper, a sole S that has a first and second roll-up portions S11, S10 rolling upwards along side faces of a foot, and first and second belts 51, 52. The first belt 51 is fixed to the first roll-up portion S11 at a first joined portion 58 on the medial side of the foot. The second belt 52 is fixed to the second roll-up portion S10 at a second joined portion 59 on the lateral side of the foot. The pair of belts 51, 52 cross each other at a position approximately above the navicular bone 91. The first belt 51 can be arranged in a tensioned state along a path extending from the medial side of the foot to the vicinity of an ankle on the lateral side of the foot through the crossing position 57. The second belt 52 can be arranged in a tensioned state along a path extending from the lateral side to the vicinity of the ankle on the medial side of the foot through the crossing position 57.

10 Claims, 11 Drawing Sheets

U.S. PATENT DOCUMENTS

| | | | | | |
|---|---|---|---|---|---|
| 5,176,624 | A | | 1/1993 | Kuehnreich | |
| 5,181,873 | A | | 1/1993 | Tolbert | |
| 5,211,672 | A | | 5/1993 | Andujar | |
| 5,269,078 | A | * | 12/1993 | Cochrane | 36/93 |
| 5,400,529 | A | | 3/1995 | Bell et al. | |
| D365,438 | S | | 12/1995 | Orzeck | |
| 5,544,430 | A | | 8/1996 | Jacko | |
| 5,699,629 | A | | 12/1997 | Munschy | |
| 5,819,439 | A | * | 10/1998 | Sanchez | 36/89 |
| 5,913,483 | A | | 6/1999 | Polk | |
| 6,052,920 | A | | 4/2000 | Bathum | |
| 6,270,468 | B1 | | 8/2001 | Townsend | |
| 6,272,772 | B1 | * | 8/2001 | Sherman | 36/89 |
| 6,490,814 | B2 | | 12/2002 | Matis | |
| 6,505,424 | B2 | | 1/2003 | Oorei et al. | |
| 6,772,541 | B1 | * | 8/2004 | Ritter et al. | 36/88 |
| 6,944,976 | B2 | * | 9/2005 | Sapp | 36/72 R |
| 2002/0088144 | A1 | | 7/2002 | Katz et al. | |
| 2002/0148142 | A1 | | 10/2002 | Oorei et al. | |
| 2003/0029057 | A1 | | 2/2003 | Suzuki et al. | |

* cited by examiner (medial side)

(lateral side)

(lateral side)

SHOE THAT FITS TO A FOOT WITH BELTS

CROSS-REFERENCE TO RELATED APPLICATIONS

The present application claims the benefit of patent application number 2003-398497, filed in Japan on Nov. 28, 2003, the subject matter of which is hereby incorporated herein by reference.

BACKGROUND OF THE INVENTION

1. Field of the Invention

The present invention relates to a shoe having improved fitting properties.

The present invention can apply to various kinds of shoes such as wrestling shoes and tennis shoes. The present invention is useful especially for fastening shoes without shoe laces to the foot.

2. Description of the Related Art

Shoes, for example for wrestling or tennis, having an inner upper covered with an outer upper, are known.

These type of shoes require that the inner upper can be easily fastened to the foot. On the other hand, because there are many movements of the foot in the widthwise direction when the player is doing the above mentioned sports, it is necessary to make the shoe fit to the foot and to support the foot so as to prevent displacement between the foot and the shoe.

It is known to fasten the upper of a shoe to the foot, by the use of fastening belts at the medial and lateral sides of the foot. For example, shoes disclosed in the following documents employ such a method.

In the shoe disclosed in Japanese Utility Model Laid-Open No. Hei 02-33611 (FIGS. 8 and 9 thereof), belts are pulled up in the vicinity of an arch on the medial and lateral sides of the foot. Such belts support the arch on the medial and lateral sides of the foot and its vicinity, but they cannot support the foot in the vicinity of the distal caput of the fifth metatarsal bone of the foot.

In the shoe disclosed in Japanese Patent Laid-Open No. 2001-112510 (Abstract), belts are pulled up in the vicinity of caput of metatarsal bones on the medial and lateral sides of the foot. The belts prevent the motion of the ball of the foot on the medial side of the foot. The shoe does not fit to the foot on the medial side.

In the shoe disclosed in Japanese Patent Laid-Open No. Hei 08-131201 (FIG. 1 thereof), a lace or belt is turned back (folded back) many times and then tightened near the ankle. As such lace or belt stretches during wearing the shoe, a sufficiently tight fit cannot be obtained. Moreover, such lace or belt cannot be used when the shoe has an inner upper covered with an outer upper.

The shoe of U.S. Pat. No. 4,557,419 (Japanese Patent Laid-Open No. Sho 60-227701) may sufficiently support and fasten the foot at the top side of an upper, that is, a leg part of the shoe. However, a reinforcing member is integrated with the upper at the side faces of the upper, the function of supporting the foot at a lower side of the upper and the function of fitting a sole to the foot are insufficient.

In the shoe of U.S. 2003/0029057 A1 (Japanese Patent Laid-Open 2003-125805), the medial and lateral sides of the foot are fastened with belts symmetrically. Therefore, when a distal caput of a fifth metatarsal bone is supported, the ball of the big toe of the foot is prevented from moving freely.

The shoe of U.S. 2003/008144 A1 has a bumper support on the lateral side of the fore foot part in addition to a strap for fastening the mid foot part. However, although the bumper support can prevent displacement between the shoe and the ground, displacement between the foot and the shoe cannot be prevented.

In the shoe of U.S. Pat. No. 6,270,468, as clearly shown in FIG. 9A thereof, straps are fixed to lower portions of the mid foot part and the rear foot part on the lateral side of the foot. Therefore, the vicinity of the distal caput of a fifth metatarsal bone cannot be supported.

SUMMARY OF THE INVENTION

Therefore, an object of the present invention is to provide a shoe having the structure in which the shoe is tightened by two belts that makes the shoe sole easily fit to the foot and that performs excellent supporting functions.

In supporting the foot, the part to be supported varies between the medial side and lateral side of the foot. That is, on the medial side of the foot, the medial side as a whole should be prevented from being displaced inward with respect to the shoe. Therefore, on the medial side of the foot, the foot should be supported mainly at the mid foot part. By applying tightening force to the foot mainly at the mid foot part, the movement of the ball of the foot and the big toe (pollex) of the foot is not obstructed.

On the other hand, on the lateral side of the foot, as the area of the foot in the vicinity of a distal caput (head) of a fifth metatarsal bone of the foot tends to be displaced with respect to the shoe sole especially due to movement of the foot in the widthwise direction, the area of the foot covering the distal caput of the fifth metatarsal bone rather than the whole of the lateral side of the foot should be prevented from being displaced outward with respect to the shoe sole. Therefore, on the lateral side of the foot, not the mid foot part (the middle part of the foot in the longitudinal direction) but the area of the foot covering the distal caput of the fifth metatarsal bone should be supported from the lateral side.

A shoe according to the present invention comprises an upper, a sole, a first belt and a second belt. The sole is joined to the upper and has a first roll-up portion rolling upwards (curling upwards) along a medial side face of a foot and a second roll-up portion rolling upwards (curling upwards) along a lateral side face of the foot. The first belt is fixed to the first roll-up portion of the sole at a first joined portion below a navicular bone and/or a medial (first) cuneiform bone on the medial side of the foot. The second belt is fixed to the second roll-up portion of the sole at a second joined portion covering a distal caput of a fifth metatarsal bone on the lateral side of the foot.

Preferably, the shoe of the present invention does not include a belt restraining the movement of a big toe in the vicinity of a ball of the foot, i.e., in the vicinity of the ball of the foot, there is no belt restraining the movement of the big toe of the foot.

The first belt has the first joined portion, a first secured portion for being secured to the upper, and a first non-fixed portion that is not fixed to any of the upper and the sole between the first joined portion and the first secured portion.

The second belt has the second joined portion, a second secured portion for being secured to the upper, and a second non-fixed portion that is not fixed to any of the upper and the sole between the second joined portion and the second secured portion.

The first non-fixed portion of the first belt and the second non-fixed portion of the second belt cross each other in the shape of X at a crossing position approximately above the navicular bone.

By having the first non-fixed portion as described above, the first belt can be arranged in a tensioned state along a path extending from below the navicular bone and/or the medial cuneiform bone on the medial side of the foot to above or below an ankle on the lateral side of the foot through the crossing position approximately above the navicular bone without being restrained by the upper.

By having the second non-fixed portion as described above, the second belt can be arranged in a tensioned state along a path extending from the position covering the distal caput of the fifth metatarsal bone to above or below the ankle on the medial side of the foot through the crossing position approximately above the navicular bone without being restrained by the upper.

The first belt presses the shoe sole against the arch the medial side of the foot (the mid foot part on the medial side of the foot) through the first roll-up portion. This allows the shoe sole including the first roll-up portion to securely fit to the medial side of the foot and permits the medial side of the foot to be supported by the first roll-up portion. Moreover, in the preferred embodiment the movement of the ball of the foot and the big toe (pollex) of the foot are not obstructed.

The second belt pulls up the shoe sole including the second roll-up portion at the position covering the distal caput of the fifth metatarsal bone on the lateral side of the foot through the second roll-up portion and presses it against the foot. Accordingly, the area of the foot covering the distal caput of the fifth metatarsal bone is supported.

Further, as, on the medial and lateral sides of the foot, the upper and the sole are pulled up toward the ankle by the respective belts without folding back (turning back) or winding the belts around the foot several times, the belts do not come loosened easily.

Since the first belt and the second belt are fixed to the roll-up portions of the sole, respectively, and the roll-up portions of the sole are directly fit to the surface of the foot and not through the upper, displacement between the foot and the sole is prevented while providing excellent support function. Moreover, the respective belt is fixed not to a thicker portion of the sole below the sole of the foot, but to the thinner roll-up portions. Accordingly, the sole is easy to fit to the foot through the roll-up portions which are easy to deform.

Further, each belt is fixed to each roll-up portion at each joined portion, but is not fixed to the upper between each joined portion and each secured portion. Accordingly, tensile force by each belt affects the mid foot part on the medial side of the foot and the fore foot part on the lateral side of the foot through the roll-up portion without being dispersed by the large upper. Therefore, the sole is easy to fit to the foot and an excellent supporting function can be achieved.

It is preferred that each belt is made of material that is difficult to stretch, i.e., "essentially difficult to stretch". By the use of the term "essentially difficult to stretch", it is meant to include the case where the belt does not stretch at all and the case where the belt hardly stretches due to the tensile force applied to the belt during putting on the shoe and during the wearing of the shoe.

In the present invention, it is preferred that the width of the first belt and the second belt gradually narrows from the respective joined portions as the belts get closer to the crossing position, i.e., they become narrower substantially gradually.

In this case, since each of the belts has a larger width at the joined portions to allow the tightening force of the belts on the foot to be dispersed along the joined portion, any pain to the foot created by the tensioning of the belts is minimized. Further, since each of the belts has a smaller width at the crossing position at the narrow space ahead of the ankle, the belts can be crossed easily at the crossing position.

In the present invention, by the use of the description "become narrower substantially gradually", it is meant that the width of each of the belts at the crossing position is smaller than that of each of the belts at the respective joined portion, and it is meant to include, for example, the case where the width of the belt becomes narrower gradually over the whole part extending from the joined portion to the crossing position and the case where the width of a part of the belt becomes narrower gradually and the width of the remaining part of the belt is set constant, i.e., only a part of the belt becomes narrower.

The shoe of the present invention is especially useful in the case where a shoe lace for fastening the shoe is not used and the case where the shoe further comprises an inner upper covering an instep of a foot and an outer upper covering at least the inner upper and a part of the pair of belts. That is, since it is difficult to fasten the shoe lace when the inner upper is covered with the outer upper, by employing above mentioned belts, the shoe can be easily fit onto the foot. Further, even when a shoe lace for fastening the shoe is used, the shoe has excellent fitting properties and support by applying the present invention.

In a preferred aspect of the present invention, a first slit is provided in the inner upper in the vicinity of the ankle on the lateral side of the foot and a second slit is provided in the inner upper in the vicinity of the ankle on the medial side of the foot. The first belt has a first double part formed doubly in a loop shape in a path extending from the crossing position to above or below the ankle on the lateral side of the foot. The second belt has a second double part formed doubly in a loop shape in a path extending from the crossing position to above or below the ankle on the medial side of the foot. A belt portion on the reverse side of the first double part passes through the first slit, and a belt portion on the reverse side of the second double part passes through the second slit In this case, since each double part of each belt in a loop shape passes through the slits and a loop parts of the belts engage with the slits, the belts are prevented from entering into the inner side of the shoe after inserting the foot into the shoe before securing the belts.

DESCRIPTION OF THE PREFERRED EMBODIMENTS

Figure 1:
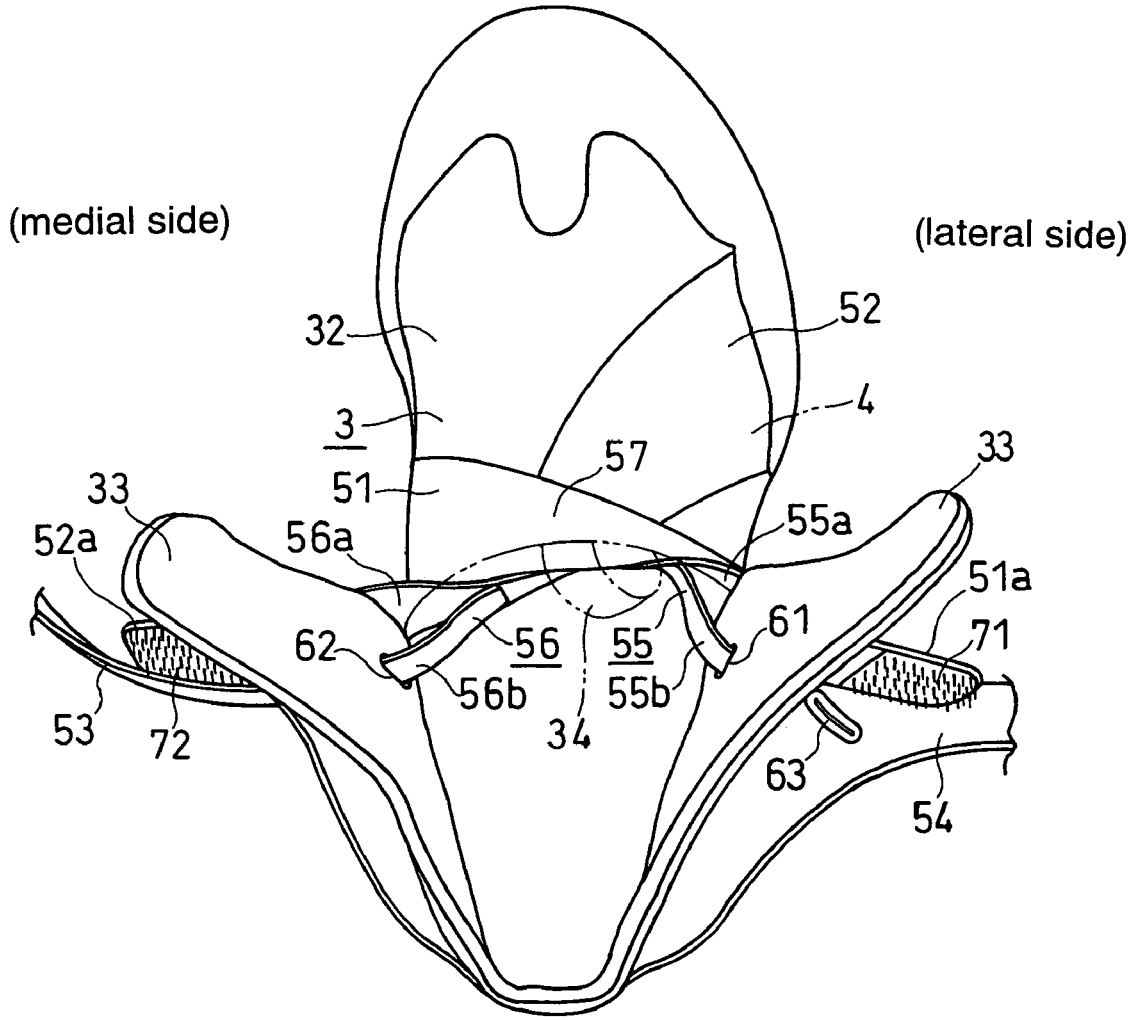
FIG. 1 is a plan view of a shoe according to a first embodiment of the present invention.

The present invention will be understood more apparently from the following description of the preferred embodiments when taken in conjunction with the accompanying drawings. However, it will be appreciated that the embodiments and the drawings are given for the purpose of mere illustration and explanation and that the scope of the present invention is to be defined by the appended claims. In the drawings annexed, the same reference numerals denote the same or corresponding parts throughout several views.

First Embodiment

A first embodiment of the present invention will be described below with reference to the figures.

Figure 4:
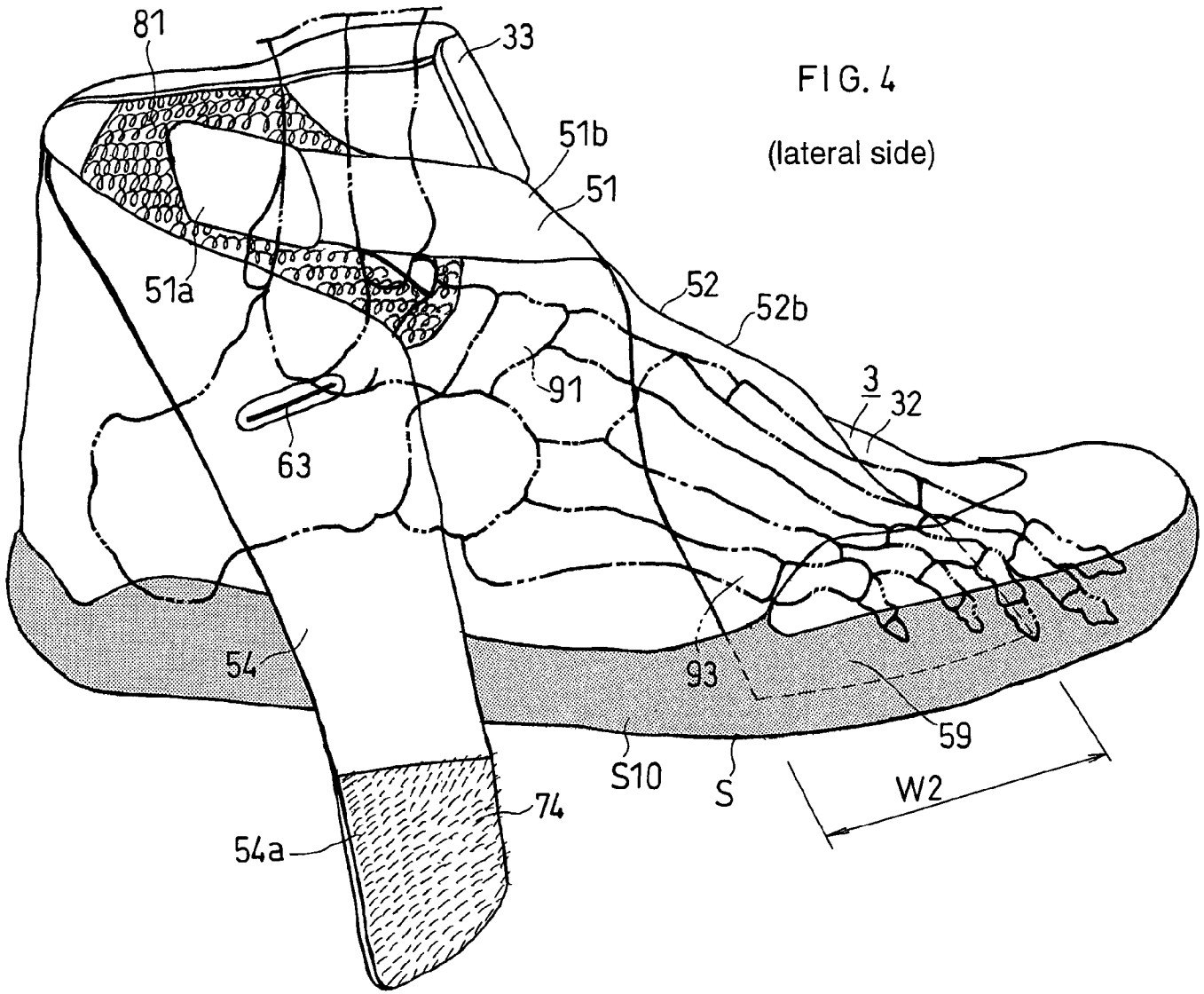
FIG. 4 is a side view of the shoe on the lateral side on which bones of the foot are superposed.
Figure 5:
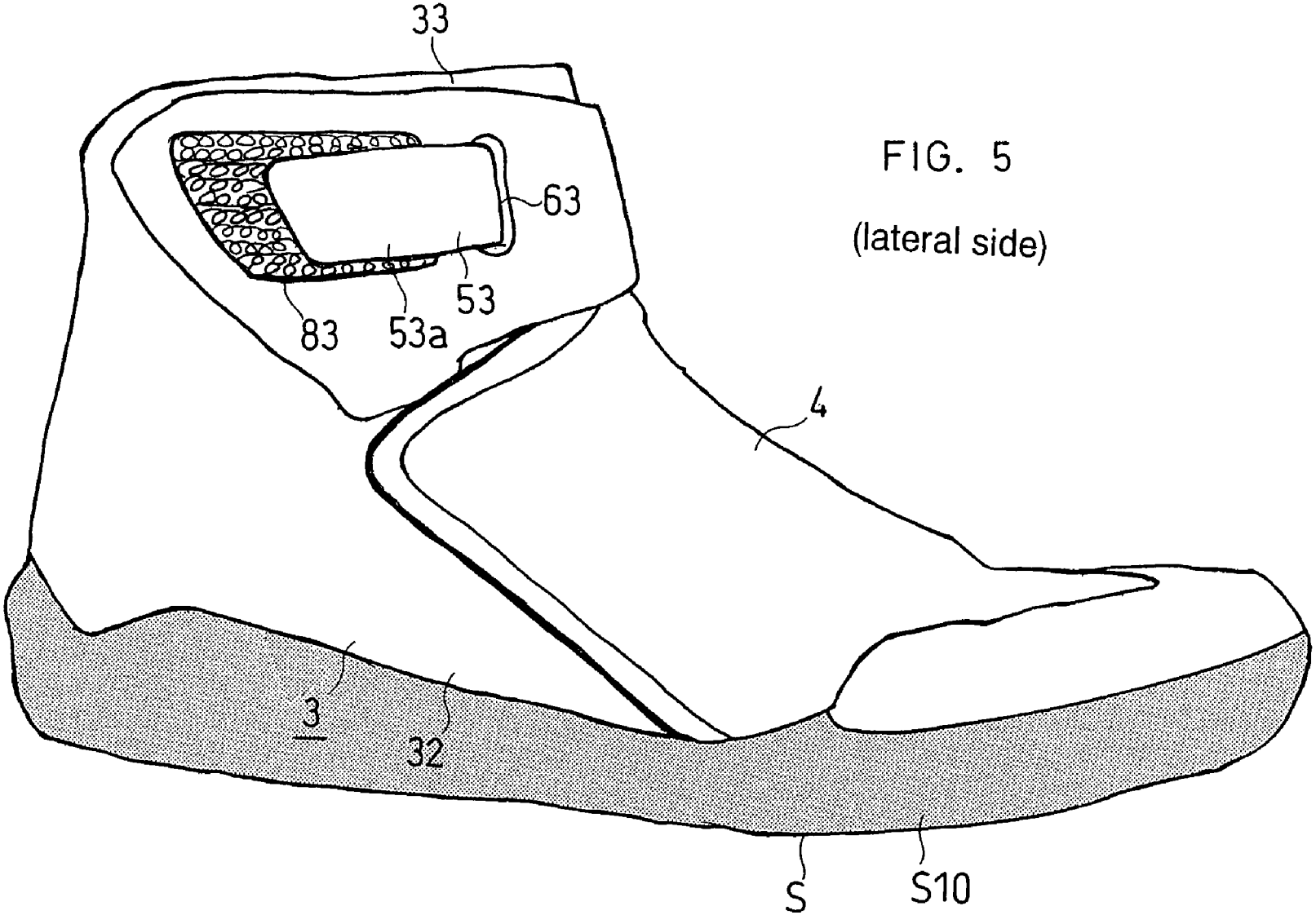
FIG. 5 is a side view of the shoe on the lateral side wherein an outer upper is attached.
Figure 6A:
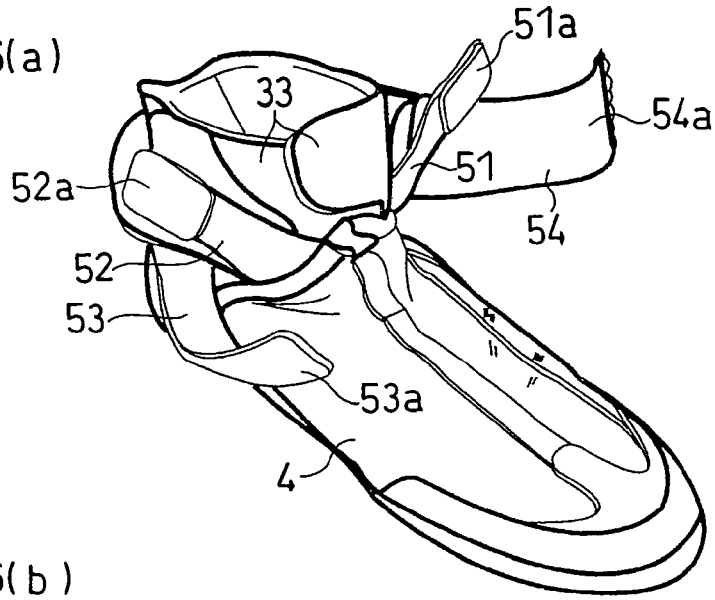
FIG. 6(*a*), FIG. 6(*b*) and FIG. 6(*c*) are perspective views showing a method of fastening the shoe to the foot.
Figure 6B:
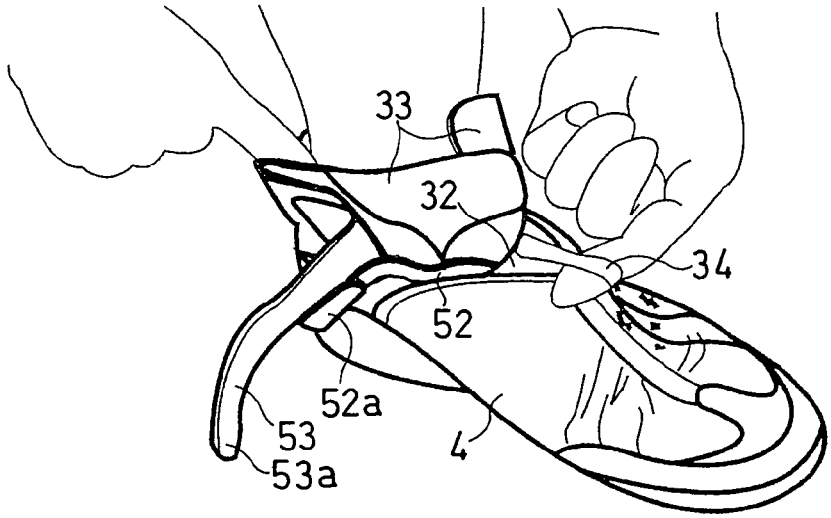
Figure 6C:
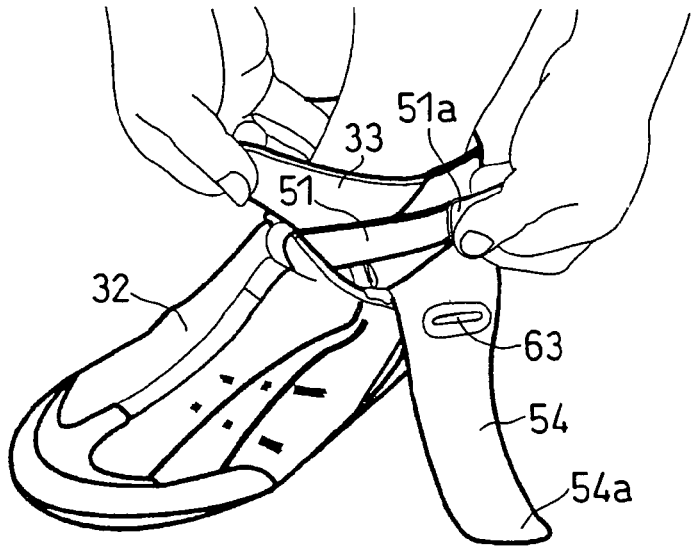
Figure 7A:
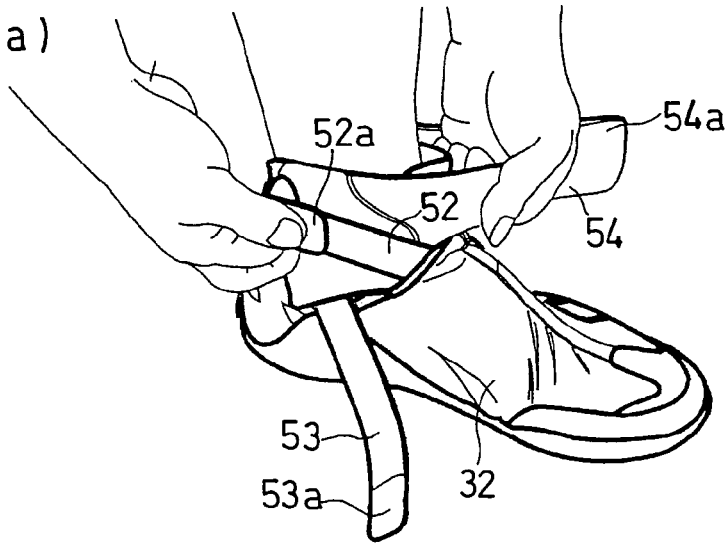
FIG. 7(*a*), FIG. 7(*b*) and FIG. 7(*c*) are perspective views showing a method of fastening the shoe to the foot.
Figure 7B:
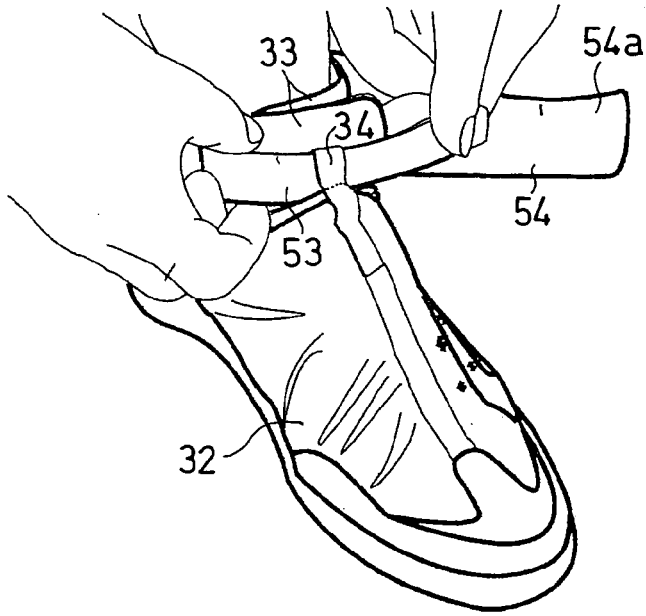
Figure 7C:
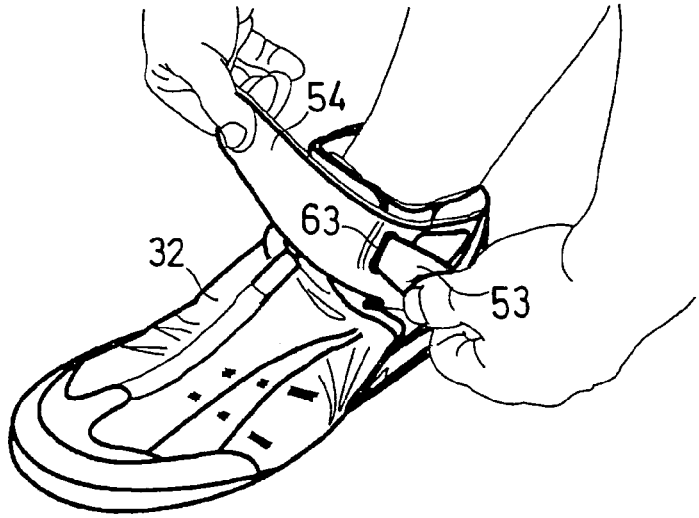

FIG. 1 to FIG. 7 show a first embodiment of a shoe for wrestling. FIG. 1 to FIG. 5 show a shoe for the right foot and FIG. 6 and FIG. 7 show a shoe for the left foot.

Figure 3:
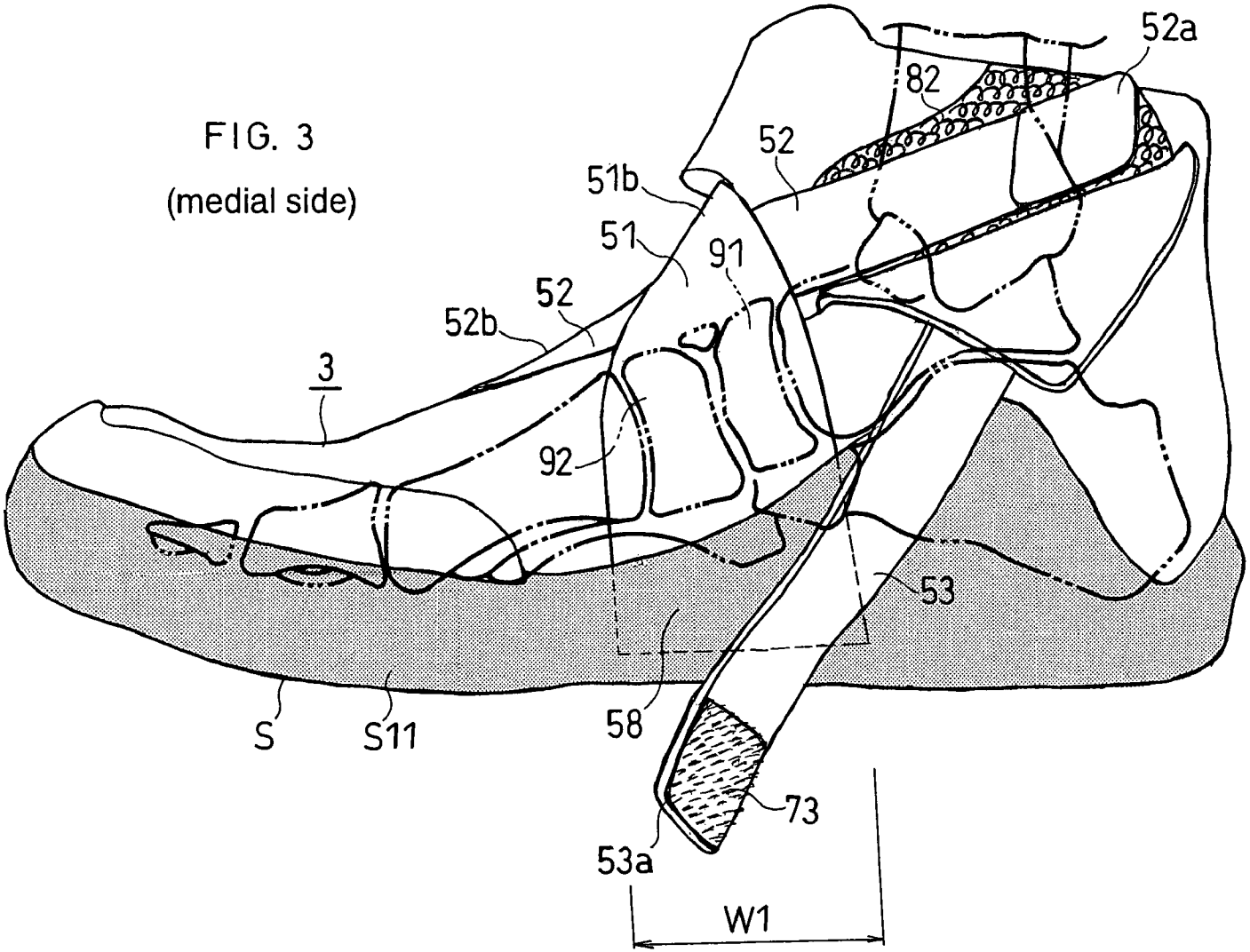
FIG. 3 is a side view of the shoe on the medial side on which bones of the foot are superposed.

As shown in FIG. 1, the shoe of this embodiment has an inner upper 3, a sole S (FIG. 3), a first belt 51 and a second belt 52. As shown in FIG. 3 and FIG. 4, the sole S supports the sole of the foot and has a grounded portion (not shown) making contact with the floor or mat and first and second roll-up portions S11 and S10. As shown in FIG. 3, the first roll-up portion S11 rolls up from the grounded portion upwards along the medial side face of the foot. As shown in FIG. 4, the second roll-up portion S10 rolls up from the grounded portion upwards along the lateral side face of the foot. In FIG. 3 to FIG. 5, in order to easily understand the location of the first and second roll-up portions S11, S10, these roll-up portions S11, S10 are shown as dot-meshed areas on the Figures.

As shown in FIG. 1, the first belt 51 and the second belt 52 cover a part of the inner upper 3 and cross each other in the shape of an X. The shoe has an outer upper 4 shown in FIG. 1 by a two-dot chain line (see also FIG. 5) and the outer upper 4 covers a part of the inner upper 3 and a part of the first belt 51 and the second belt 52 in an area anterior to the ankle.

Figure 2:
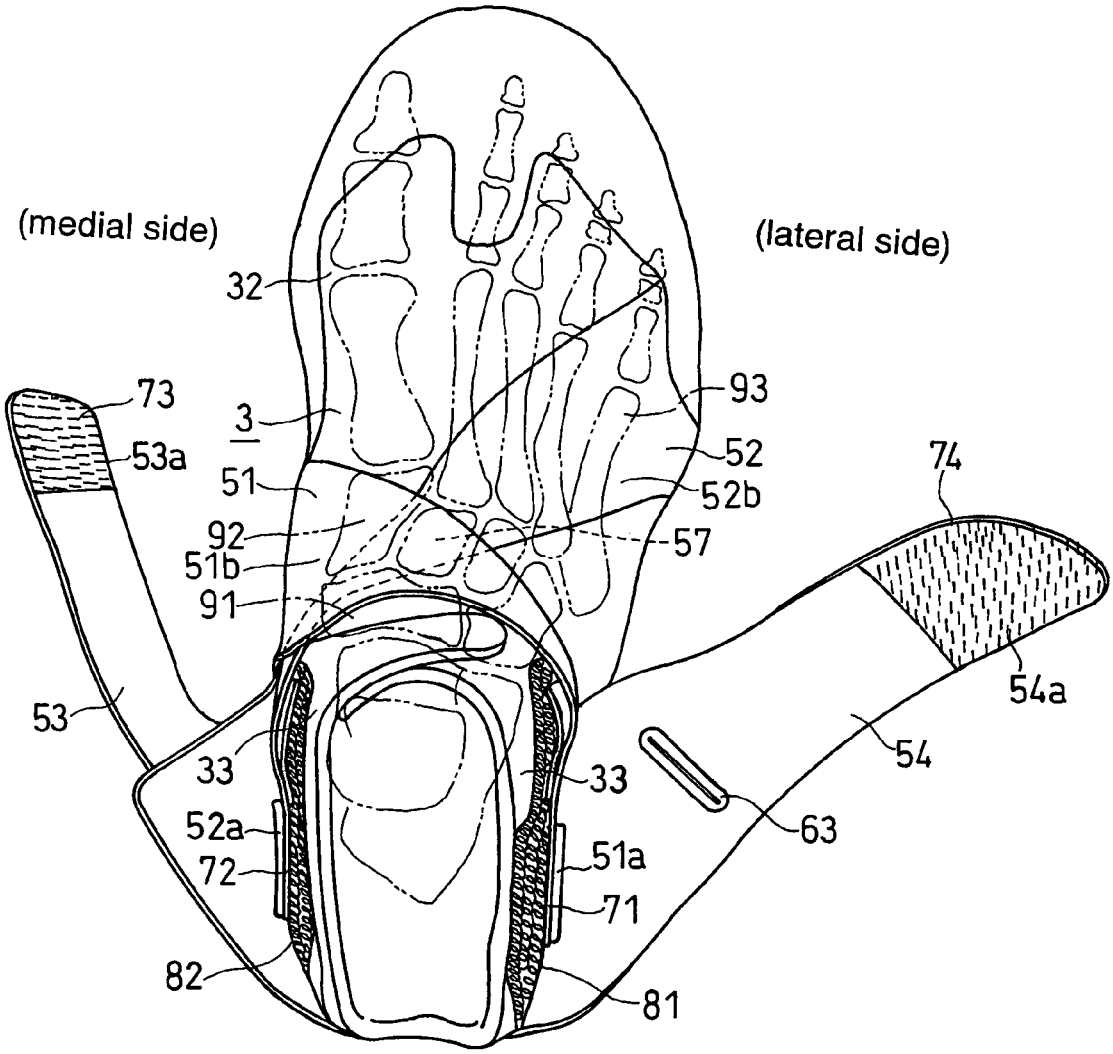
FIG. 2 is a plan view of the shoe on which the bones of the foot are superposed.

FIG. 1 to FIG. 4 show the shoe wherein the outer upper has been removed to clearly illustrate the configuration of the inner upper 3, the belts 51, 52 and so on. FIG. 1 depicts a loose first belt 51 and second belt 52. FIG. 2 to FIG. 4 shows both belts fastened.

Firstly, the first belt 51 and the second belt 52 will be described.

As shown in FIG. 1, the first belt 51 extends from the medial side of the foot toward the back of the lateral side of the foot to wrap around the forward part of the ankle. On the medial side of the foot, the first belt 51 is fixed to the side face of the inner upper 3 and the first roll-up portion S11 of the sole S at an portion below a navicular bone 91 and a medial cuneiform bone 92 (FIG. 3), that is, a first joined portion 58. This first joined portion 58 is the portion corresponding to the arch of the medial side of the foot. As shown in FIG. 2, in the forward part of the ankle, the first belt 51 passes above the navicular bone 91 and the medial cuneiform bone 92. As shown in FIG. 4, a first secured portion 51*a* of the first belt 51 is secured or locked to the inner upper 3 above the ankle on the lateral side of the foot.

As shown in FIG. 1, the second belt 52 extends from the lateral side of the foot toward the back of the medial side of the foot so as to wrap around the forward part of the ankle. On the lateral side of the foot, the second belt 52 is fixed to the side face of the inner upper 3 and the second roll-up portion S10 of the sole S at a portion covering a distal caput of a fifth metatarsal bone 93 (FIG. 4), that is, a second joined portion 59. As shown in FIG. 2, in the forward part of the ankle, the second belt 52 passes above the navicular bone 91 and the medial cuneiform bone 92. As shown in FIG. 3, a second secured portion 52*a* of the second belt 52 is secured or locked to the inner upper 3 above the ankle on the medial side of the foot.

The first and second belts 51 and 52 may be secured or locked below the ankle of the foot.

On the sole S, a roll-up part that rolls upwards is formed continuously along the entire peripheral edge of the sole S. The roll-up part including the first roll-up portion S11 and the second roll-up portion S10 does not include any filler or any insole, different from the grounded portion of the sole. Accordingly, the roll-up part is easy to deform due to tensile force by the first and second belts.

The first belt 51 has a first non-fixed portion 51*b* and the second belt 52 has a second non-fixed portion 52*b*. The first non-fixed portion 51*b* is arranged between the first secured portion 51*a* and the first joined portion 58 (FIG. 3), and is not fixed to the inner upper 3 or the sole S, i.e., not fixed to either the inner upper 3 or the sole S.

The second non-fixed portion 52*b* is arranged between the second secured portion 52*a* and the second joined portion 59 (FIG. 4), and is not fixed to the inner upper 3 or the sole S, i.e., not fixed to either the inner upper 3 or the sole S. Accordingly, the belts 51, 52 are not restrained by the inner upper 3 and so on, and so, when the first and the second belts 51, 52 are pulled, the tensile force of these belts is transmitted directly to the roll-up portions S10, S11 through the joined portions 58, 59.

Figure 11A:
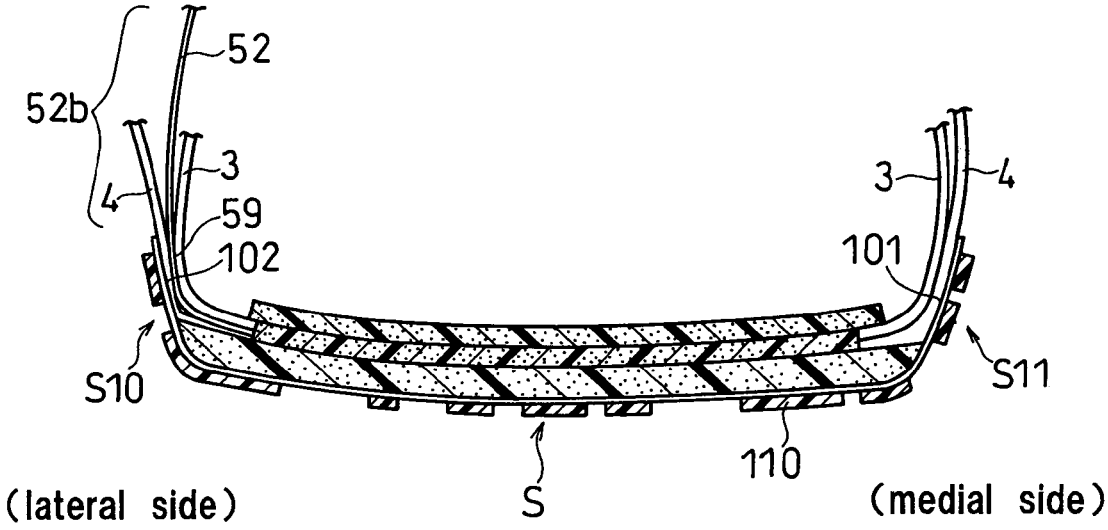
FIG. 11(*a*) is a partial transverse sectional view of the shoe in the fore foot part according to the first embodiment, and FIG. 11(*b*) is a sectional view showing a modified example of the belt.
Figure 11B:
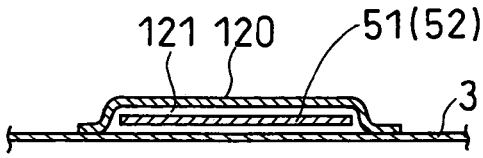

As shown in FIG. 11(*a*), the second roll-up portion S10 has a second face 102 joined to the inner upper 3. This second face 102 is an inner side face of the second roll-up portion S10. The second joined portion 59 of the second belt 52 overlaps the second face 102. That is, the second joined portion 59 is superposed on the second face 102 via the outer upper 4. For example, the second joined portion 59 may be arranged between the second roll-up portion S10 and the surface of the foot and joined to the second roll-up portion S10 (the inner side of the second roll-up portion S10). As shown in FIG. 11(*a*), onto the surface of the shoe sole S according to this embodiment, a plurality of protrusions 110 made of rubber or resin are adhesive bonded. In the other figures, the illustration of the protrusions 110 is omitted.

As shown in FIG. 11(*a*), the first roll-up portion S11 has a first face 101 joined to the inner upper 3. This first face 101 is an inner side face of the first roll-up portion S11. Similarly to the second joined portion 59 of the second belt 52, the first joined portion 58 of the first belt 51 overlaps the first face 101. That is, the first joined portion 58 is superposed on the first face 101, via the outer upper 4. For example, the first joined portion 58 may be arranged between the first roll-up portion S11 and the surface of the foot and joined to the first roll-up portion S11 (the inner side of the first roll-up portion S11).

As shown in FIG. 2, the non-fixed portions 51*b*, 52*b* of the first and second belts 51, 52 cross each other in the shape of X at a crossing position 57 above the navicular bone 91 and its vicinity. One belt 51 (52) is superposed on the other belt 52 (51) at the crossing position 57 without being bonded (fixed) to each other.

The two belts are not bonded to each other at the crossing position 57 and they are not essentially restrained by each other. Accordingly, even if tensile force is applied to one belt 51 (52), the tensile force does not essentially affect on the other belt 52 (51).

As shown in FIG. 3 and FIG. 4, the width of the first and second belts 51, 52 becomes narrower substantially gradually as these belts 51, 52 get closer to the crossing position 57 from the respective joined portions 58 and 59. On the other hand, the width of these belts 51, 52 between the crossing position 57 and the first and second secured portions 51*a*, 52*a* is set to be approximately constant.

In addition, it is preferred that the first and second belt 51 and 52 have a predetermined width W1, W2 (FIG. 3, FIG. 4) at the respective joined portions 58, 59 so as to prevent or minimize any pain in the foot by dispersing the fastening pressure by the belts on the foot and not to block the movement of the foot unnecessarily. The width W1, W2 of the belts at the respective joined portion 58, 59 is set to be generally about 30 mm to 80 mm, preferably about 40 mm to 70 mm and more preferably about 40 mm to 60 mm. The width W1 may be set different from the width W2.

As shown in FIG. 1, the secured portions 51*a*, 52*a* of the first and second belts 51, 52 are provided with a first male Hook-and-Loop fastener 71 and a second male Hook-and-Loop fastener 72, respectively.

The first belt 51 has a first double part 55 formed doubly in the shape of a loop between the crossing position 57 and the first secured portion 51*a*. The first double part 55 is separated into a belt portion 55*a* on a front side and a belt portion 55*b* on a reverse side.

Similarly, the second belt 52 has a second double part 56 between the crossing position 57 and the second secured portion 52*a*. The second double part 56 is separated into a belt portion 56*a* on a front side and a belt portion 56*b* on a reverse side.

Next, the inner upper 3 will be described below.

As shown in FIGS. 1-4, the inner upper 3 has an instep portion 32 covering the instep of the foot and an ankle portion 33 covering the ankle of the foot. Both portions 32, 33 are joined to each other by sewing in the backward of the ankle.

Figure 10:
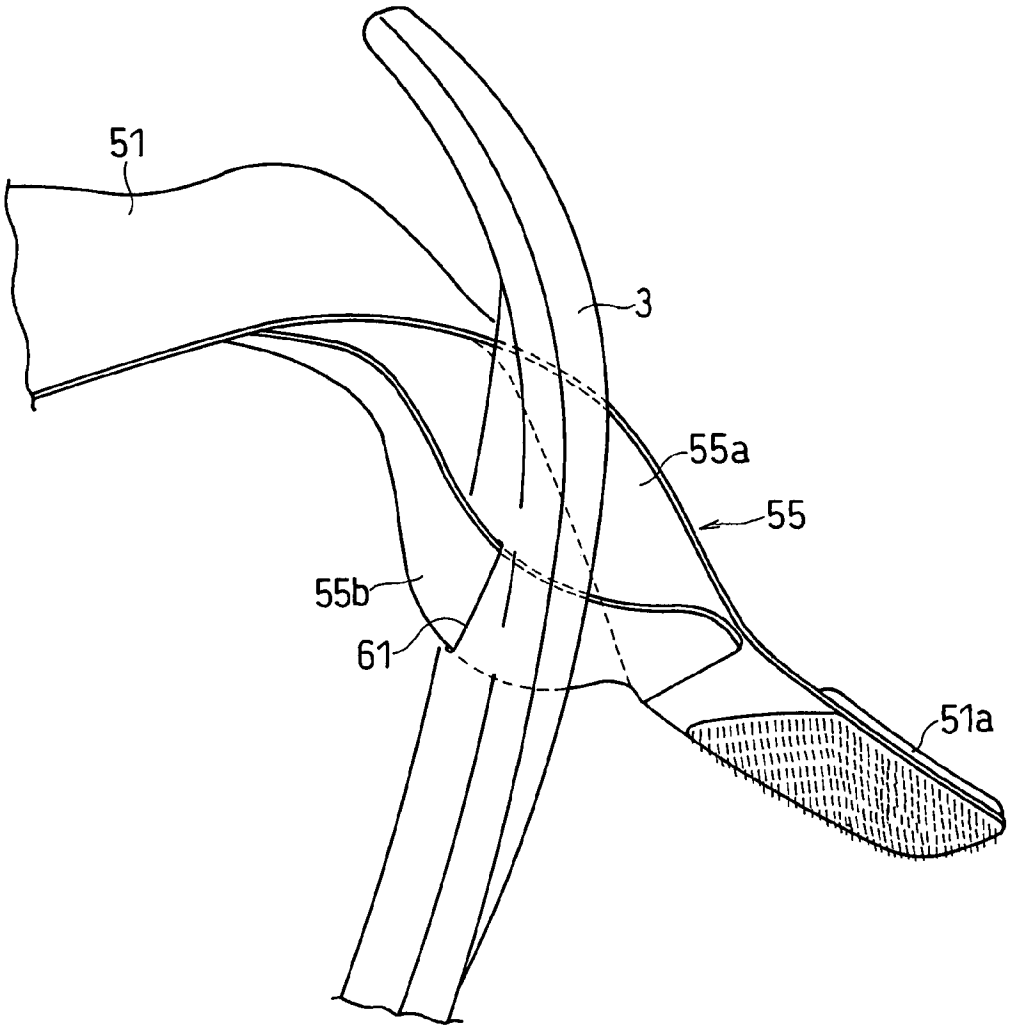
FIG. 10 is a large partial perspective view showing the first double part of the first belt.

As shown in FIG. 1, a first slit 61 is provided on the lateral side of the ankle portion 33 and a second slit 62 is provided on the medial side of the ankle portion 33. As shown in FIG. 10, the belt portion 55*b* on a reverse side of the first double part 55 passes through the first slit 61. Though an illustration is not shown, the belt portion 56*b* on a reverse side of the second double part 56 passes through the second slit 62, in a similar way to the belt portion 55*b* on the reverse side of the first double part 55. By such a structure, the first and second double parts 55, 56 are secured to the inner upper 3.

As shown in FIG. 2, a first female Hook-and-Loop fastener 81 and a second female Hook-and-Loop fastener 82 are formed on the side faces of the ankle portion 33. The first male Hook-and-Loop fastener 71 of the first belt 51 can be detachably joined to the first female Hook-and-Loop fastener 81. Similarly, the second male Hook-and-Loop fastener 72 of the second belt 52 can be detachably joined to the second female Hook-and-Loop fastener 82.

This allows the secured portions 51*a*, 52*a* of the first and second belts 51, 52 to be detachably joined or detachably secured to the ankle portion 33 of the inner upper 3.

Next, the outer upper 4 will be described below.

As shown in FIG. 5, the outer upper 4 is fixed to the sole S and the instep portion 32 of the inner upper 3. The outer upper 4 is provided so as to cover the ankle part 32 of the inner upper 3 and a part of the first and second belts 51 and 52 (not shown). Such outer upper 4 prevents, for example, the wrestler's hand from touching or engaging with the belts while wrestling.

The outer upper 4 and the inner upper 3 are connected to each other in the vicinity of the crossing position 57. The connected part constitutes a belt-like loop 34 in FIG. 7(*b*).

As shown in FIG. 2, the shoe of this embodiment has a third belt 53 and a fourth belt 54. Both of the belts 53, 54 are fixed to a rear foot part of the inner upper 3 by sewing. The third belt 53 is provided so as to cover a substantially whole face of the second female Hook-and-Loop fastener 82. The fourth belt. 54 is provided so as to cover a substantially whole face of the first female Hook-and-Loop fastener 81.

A third male Hook-and-Loop fastener 73 is provided on a third secured portion 53*a* of the third belt 53. A fourth male Hook-and-Loop fastener 74 is provided on a fourth secured portion 54*a* of the fourth belt 54. A third slit 63 is provided on the fourth belt 54. The third belt 53 passes through the third slit 63 (FIG. 5).

While the user wears the shoe, both of the belts 53, 54 are wound around the ankle so as to overlap each other. This constitutes a covering part covering the secured portions 51*a*, 52*a* of the first and second belts 51, 52. Both of the belts 53, 54 are fixed around the ankle by joining the male Hook-and-Loop fasteners 73, 74 to a female Hook-and-Loop fastener 83 (FIG. 5).

By providing the covering part, any disengagement of the belts or contact of the belts with, for example the wrestler while wrestling or the like, are prevented.

The third belt 53 is inserted through the loop 34 in FIG. 7(*b*) before passing through the third slit 63. As this enables the user to draw up the inner upper 3 during putting on the shoe, the shoe is easy to wear and the inner upper 3 is prevented from entering into the depths of the inner side of the shoe.

Next, a method of putting on the shoe of this embodiment will be described. FIG. 6 and FIG. 7 show the method of putting on the shoe.

Firstly, as shown in FIG. 6(*a*), all of the belts 51, 52, 53, 54 are loosened. Then, the loop 34 in the FIG. 6(*b*) is pulled ahead (outward from the foot), the instep portion 32 of the inner upper 3 is drawn up and the foot is inserted into the shoe while expanding the opening of the shoe.

Subsequently, as shown in FIG. 6(*c*), the first belt 51 is drawn up and the first secured portion 51*a* is fixed to a position above the ankle on the lateral side of the foot. Then, as shown in FIG. 7(*a*), the second belt 52 is drawn up and the second secured portion 52*a* is fixed to a position above the ankle on the medial side of the foot. This allows the shoe sole S to fit to the sole of the foot and the inner upper 3 (not shown) to be fastened to the instep of the foot.

At this time, as the female Hook-and-Loop fasteners 81, 82 in FIG. 3 and FIG. 4 are provided over a relatively large area on the lateral and medial sides of the ankle, the fixed positions of the secured portions 51*a*, 52*a* can be adjusted according to the user's foot.

Next, as shown in FIG. 7(*b*), the third belt 53 is inserted through the loop 34. Then, as shown in FIG. 7(*c*), the third belt 53 is inserted through the third slit 63. Subsequently, the third and fourth belts 53 and 54 are pulled, and the secured portions 53*a*, 54*a* are fixed to the lateral and medial sides of the ankle. As a result, the third and fourth belts 53, 54 cover the secured portions 51*a*, 52*a* of the first and second belts 51, 52 and fasten the inner upper 3 around the ankle.

In such manner, the shoe of this embodiment is put on and secured to the foot.

Second Embodiment

Figure 8:
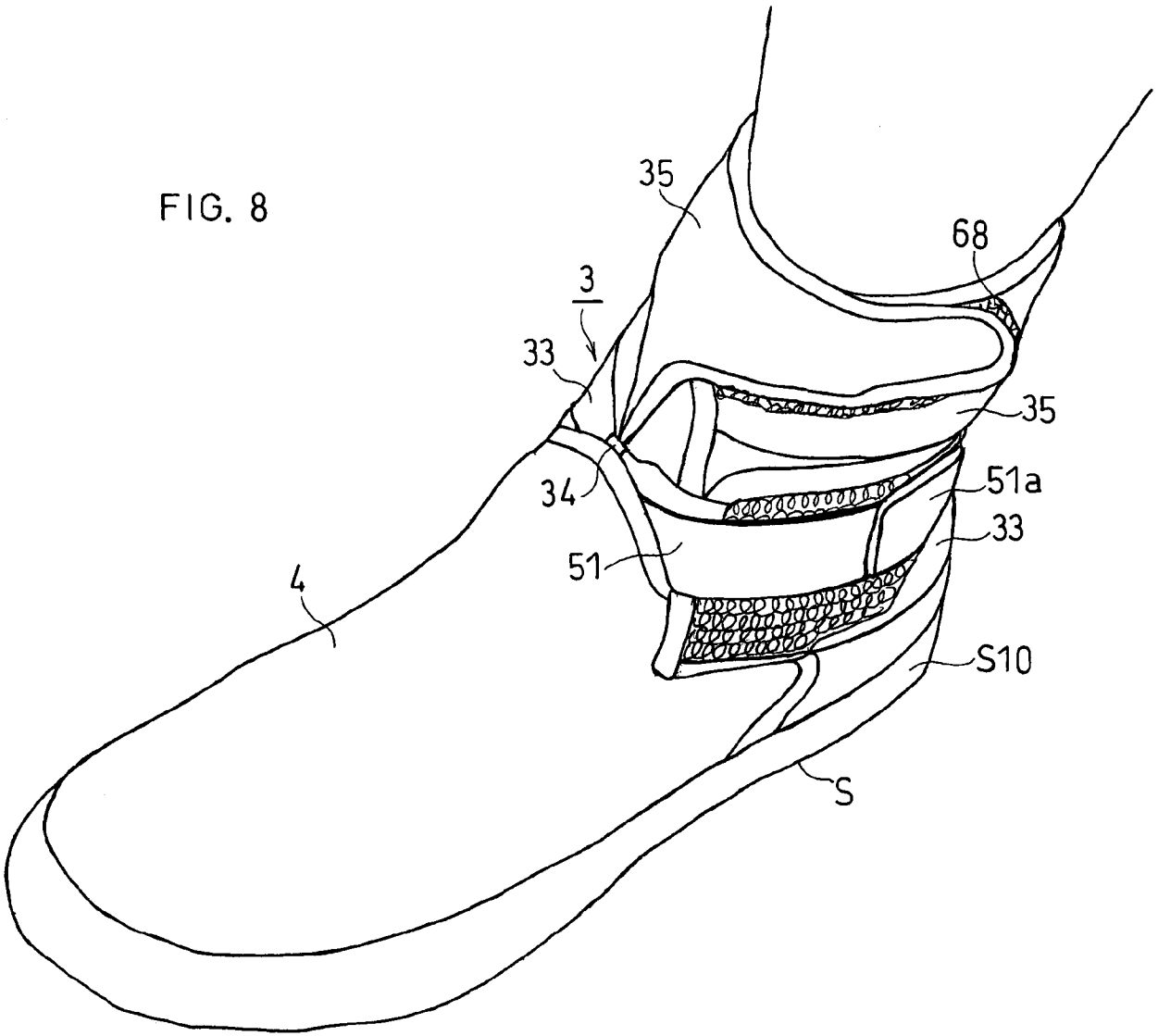
FIG. 8 is a perspective view of a shoe according to a second embodiment of the present invention.
Figure 9:
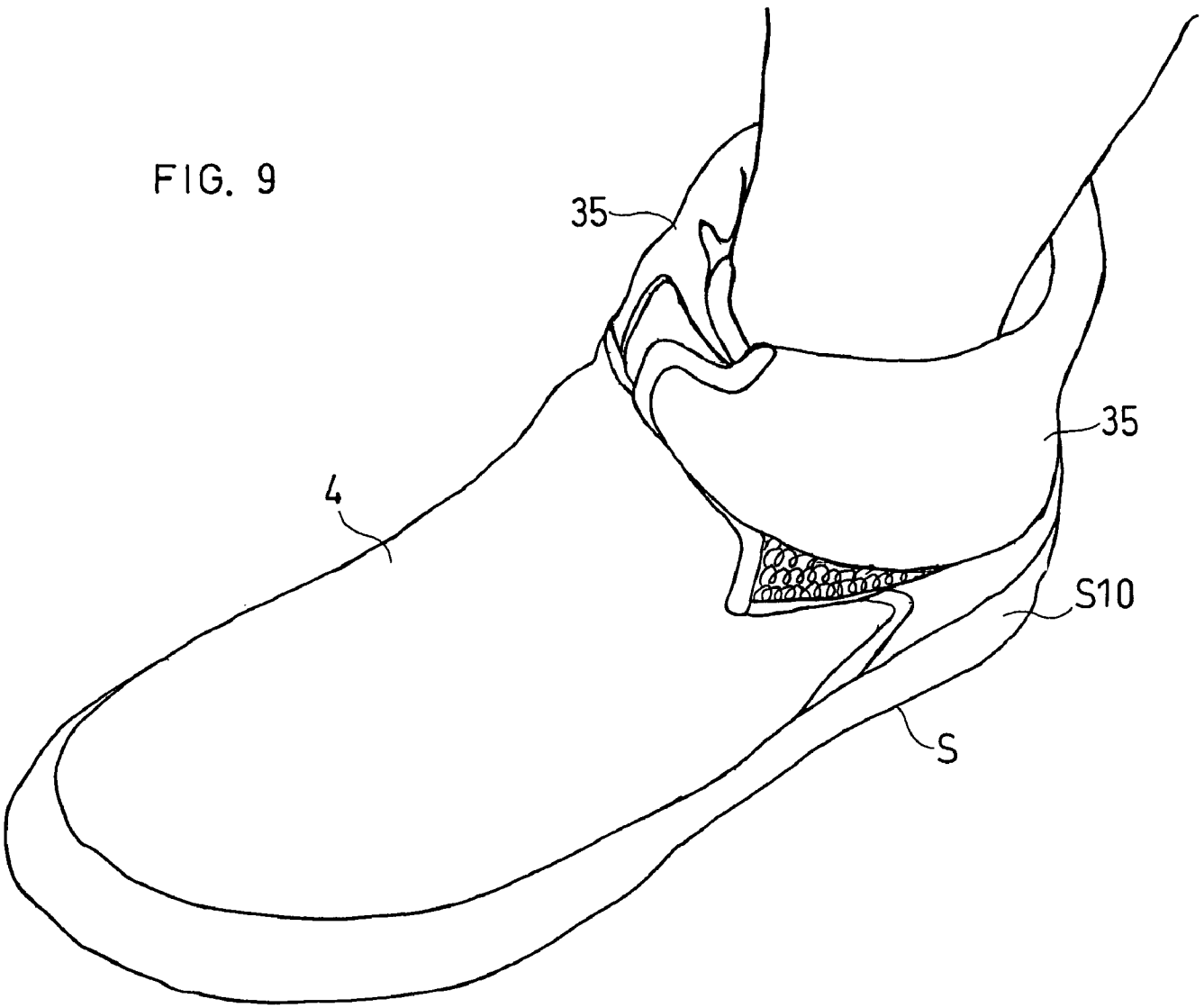
FIG. 9 is a perspective view of a shoe wherein a portion of the upper around the ankle is folded over.

FIG. 8 and FIG. 9 show a shoe (for the left foot) of a second embodiment. In the following description of this embodiment, the parts which are identical or corresponding to those of the first embodiment are designated by the same reference numerals as the first embodiment and the detailed description and illustration thereof will be omitted.

As shown in FIG. 8, in the shoe of this embodiment, the inner upper 3 extends above the ankle to form a substantially cylindrical folding portion 35. The folding portion 35 is split to the medial and lateral sides ahead of the ankle. The folding portion 35 is made of a flexible material having stretching property and can be folded with ease.

When putting on the shoe, the foot is inserted into the shoe from the folding portion 35 and then the folding portion 35 is folded back after fastening of the first and second belts 51, 52. As a result, as shown in FIG. 9, the folding portion 35 covers the secured portions 51*a*, 52*a* of the belts 51, 52.

In the above embodiments, the belt 51(52) is not fixed to the inner upper 3. As a modified example of such belt, the belt 51(52) shown in FIG. 11(*b*) can be adopted. In this modified example, a belt guide part 120 is provided on the inner upper 3. The belt 51(52) is inserted through a hole 121 between the inner upper 3 and the belt guide part 120, and is arranged slidable with respect to the inner upper 3, i.e., slidably affixed on the inner upper.

In addition to the belt of this modified example, belts that are not restrained by the upper at the time of fastening can be adopted to the present invention because such belts are substantially not fixed to the upper.

As described above, although the preferred embodiments have been described with reference to the drawings, one of ordinary skill in the art could conceive various modifications and corrections within an obvious range by referring to the present specification.

For example, the outer upper covering the inner upper and the belts need not be provided.

Although in the above embodiments the belts are secured with Hook-and-Loop fasteners, the belts may be secured by using other securing methods.

Accordingly, all such modifications are intended to be included within the scope of the invention.

What is claimed is:

1. A shoe comprising:

an upper;

a sole that is joined to the upper and has a first roll-up portion rolling upwards along a medial side face of a foot and a second roll-up portion rolling upwards along a lateral side face of the foot;

a first belt fixed to the first roll-up portion of the sole at a first joined portion below a navicular bone and/or a medial cuneiform bone on the medial side of the foot; and a second belt fixed to the second roll-up portion of the sole at a second joined portion covering a distal caput of a fifth metatarsal bone on the lateral side of the foot, the first belt has the first joined portion, a first secured portion to be secured to the upper, and a first non-fixed portion that is not fixed to the upper or the sole between the first joined portion and the first secured portion, the second belt has the second joined portion, a second secured portion to be secured to the upper, and a second non-fixed portion that is not fixed to the upper or the sole between the second joined portion and the second secured portion, the first non-fixed portion of the first belt and the second non-fixed portion of the second belt cross each other in the shape of X at a crossing position approximately above the navicular bone, by having the first non-fixed portion, the first belt can be arranged in a tensioned state along a path extending from below the navicular bone and/or the medial cuneiform bone on the medial side of the foot to above or below an ankle on the lateral side of the foot through the crossing position approximately above the navicular bone without being restrained by the upper, and by having the second non-fixed portion, the second belt can be arranged in a tensioned state along a path extending from the position covering the distal caput of the fifth metatarsal bone to above or below the ankle on the medial side of the foot through the crossing position approximately above the navicular bone without being restrained by the upper.

2. A shoe according to claim 1, wherein the first roll-up portion has a first face joined to the upper and the first joined portion of the first belt overlaps the first face, and the second roll-up portion has a second face joined to the upper and the second joined portion of the second belt overlaps the second face.

3. A shoe according to claim 1, wherein the first belt and the second belt are made of material which is essentially difficult to stretch.

4. A shoe according to claim 1, wherein each of the first and second belts is narrower in width at the crossing position than at their respective joined portion.

5. A shoe according to claim 1, wherein the upper comprises an inner upper covering an instep of the foot and an outer upper covering the inner upper and the pair of belts.

6. A shoe according to claim 5, wherein a first slit is provided in the inner upper in the vicinity of the ankle on the lateral side of the foot, a second slit is provided in the inner upper in the vicinity of the ankle on the medial side of the foot, the first belt has a first double part formed doubly in a loop shape in a path extending from the crossing position to above or below the ankle on the lateral side of the foot, the second belt has a second double part formed doubly in a loop shape in a path extending from the crossing position to above or below the ankle on the medial side of the foot, a belt portion on the reverse side of the first double part passes through the first slit, and a belt portion on the reverse side of the second double part passes through the second slit.

7. A shoe according to claim 5, wherein a first secured portion of the first belt is detachably secured to the inner upper in the vicinity of the ankle on the lateral side of the foot, and a second secured portion of the second belt is detachably secured to the inner upper in the vicinity of the ankle on the medial side of the foot.

8. A shoe according to claim 7, further comprising a covering part for covering the two secured portions.

9. A shoe according to claim 8, wherein the covering part is composed of a third belt and a fourth belt that are secured to the inner upper around the ankle so as to bind the ankle.

10. A shoe according to claim 8, wherein the inner upper further comprises a folding portion folded downward and the folding portion constitutes the covering part.

* * * * *